United States Patent [19]

Egerer

[11] 4,075,738

[45] Feb. 28, 1978

[54] CIRCULAR COMB FOR COMBING MACHINES

[75] Inventor: Josef Egerer, Schwabach, Germany

[73] Assignee: Staedtler & UHL, Schwabach, Germany

[21] Appl. No.: 703,109

[22] Filed: Jul. 6, 1976

[30] Foreign Application Priority Data

Jul. 10, 1975 Germany ..... 2530839

[51] Int. Cl.[2] ..... D01G 19/10

[52] U.S. Cl. ..... 19/234

[58] Field of Search ..... 19/115 R, 97, 233, 234

[56] References Cited

U.S. PATENT DOCUMENTS 3,665,558 5/1972 Egerer ..... 19/234

FOREIGN PATENT DOCUMENTS 2,305,110 9/1973 Germany ..... 19/234

1,031,418 6/1966 United Kingdom ..... 19/234

*Primary Examiner*—Dorsey Newton

*Attorney, Agent, or Firm*—Haseltine, Lake & Waters

[57] ABSTRACT

A circular comb arrangement in which a segment-shaped member has individual needle strips located parallel to each other and connected by pressure strips fastened to the segment-shaped member under pressure. The latter has a cutout holding all needle strips and pressure strips. The pressure strips are in the form of a flexible lamination having a free end fastened inside the cutout of the segment-shaped member. A pressure member is connected to the lamination, and one pressure surface of the pressure member is in contact with the subsequent needle strip as supporting surface. Behind the last needle strip, there is located a clamping strip which is detachably connected to the segment-shaped member. The clamping strip presses all needle strips and pressure members against one another and against a support surface ahead of the first needle strip. On the forward end of the cutout when viewed in the direction of rotation of the basic or segment-shaped member, there is located the support surface for the first row of needles. The clamping strip closes the rear end of the cutout.

7 Claims, 7 Drawing Figures

CIRCULAR COMB FOR COMBING MACHINES

BACKGROUND OF THE INVENTION

The present invention relates to a circular comb for combing machines with a segment-shaped basic element on which the individual needles (teeth) are located parallel to each other and are connected by pressure strips fastened to the basic element under pressure.

In modern combing technology, the teeth (needles) are no longer fastened to a barrette (or bar), but to a wire or strip-like needle carrier to which they are soldered, welded or glued. For fastening such needle strips to a circular comb in a known embodiment (e.g. German Patent DT-OS No. 2,002,020), wedge-shaped grooves are located on the outside circumference of the basic element at predetermined intervals. Needle strips are inserted into these grooves and are pressed by means of a wedge-shaped clamping strip against the webs of the basic element remaining between the grooves. The necessary pressure is achieved by a number of screws distributed in the lengthwise direction over the clamping strip. These screws are threaded into the basic element. Since the combs are relatively close together and the needle tips in the peripheral direction are only 8 mm apart at the outside circumference of the basic element, and since the clamping strips are tapering conically inward, only very small screws can be used for fasteners. The same applies with respect to the pressure screws for detaching the clamping strips from the basic element; additional threads for these must be located in the clamping strip. When replacing the needle strips, a large number of small screws must be unscrewed and tightened again; this requires a considerable expenditure of time.

It is also known in the art how to screw fasten the individual needle strips one after the other to the basic element of a circular comb. The first needle strip is placed on the outside of the basic element and fastened by means of a wedge-shaped strip through which the screws pass to engage the threads in the basic element. The needle strip is pressed between the basic element and the wedge-shaped strip. This procedure is repeated till the last needle strip of the segment is reached; it is followed by a final segment which is designed so that the circular comb can be mounted on the machine shaft. The manufacture of such a circular comb is expensive. Even greater is the disadvantage that the individual needle strips cannot be exchanged one for one. In the extreme case, all preceding needle strips of such a circular comb must be removed before the last needle strip can be detached and replaced. This results in extremely cumbersome shutdowns.

It is, therefore, an object of the present invention to simplify the fastening of the needle strip on the circular comb of a combing machine and to provide individual interchangeability of the individual needle strips, regardless of whether it is the first or the last or any other needle strip.

Another object of the present invention is to provide a circular comb arrangement which may be economically fabricated and maintained in service.

A further object of the present invention is to provide a circular comb arrangement, as described, which has a substantially long operating life.

SUMMARY OF THE INVENTION

The objects of the present invention are achieved by providing that basic element has a cutout holding all needle strips and pressure strips. The pressure strips are located between two needle strips each and comprise a flexible lamination whose free end is fastened inside the cutout of the basic element, and a pressure member connected to the lamination. One pressure surface of the pressure member is in contact with the subsequent needle strip as supporting surface. Behind the last needle strip, there is located a clamping strip, detachably connected to the basic element. This clamping strip presses all needle strips and pressure strips against one another and against a support surface ahead of the first needle strip.

With this design for the circular comb and its needle strips, the pressure strips are intended for the permanent connection to the basic element; merely the individual needle strips need to be inserted. The pressure force is furnished by the clamping strip to be fastened to the basic element; this force is transmitted from one pressure strip to the other down to the last pressure strip which finally finds a support surface at the end of the cutout in the basic element. If the clamping strip is detached, all needle strips are accessible individually and can be replaced easily. After installing a new needle strip, the clamping strip is again fastened to the basic element with its fastening screws, and the individual needle strips are precisely located in their mounting on the circular comb.

The design in accordance with the present invention allows two alternatives for the design of the pressure strips carrying the needle strips. With a first embodiment, the support surface for the first row of needles may be located on the forward end (in the direction of rotation of the basic element) of the cutout, while the clamping strip closes off the rear end of the cutout. The opposite arrangement is that the support surface for the first row is located at the rear end (in the direction of rotation of the basic element) of the cutout and the clamping strip closes off the forward end of the cutout.

In another embodiment of the present invention, the cross-section of the clamping strip may be a circle segment of the basic element. The contact surface of this clamping strip forms a chord on the outside periphery of the basic element. The projecting part of this circle segment forms the end of the cutout from the basic element and bears against the last needle strip and presses it against the pressure strip ahead of it. This force continues to be transferred till the last pressure strip in the row is reached which finds a support surface on the other end of the cutout, with the needle strip in between.

The same situation prevails when, in accordance with another improvement of the present invention, the cross-section of the clamping strip is wedge-shaped. This requires a suitable shape of the contact surface at the end of the cutout of the basic element so that the latter may serve as wedge surface. This wedge-shaped clamping strip is pressed by means of threaded studs in the wedge direction into the cutout in the basic element. With its free surface, it acts on the adjacent needle strip which transmits the force to the pressure strip contacting it, and this action is continued to the last row of needles which contact the support surface at the end of the cutout of the basic element.

The invention further provides that the pressure strip at its pressure surface or at its support surface has a step in its lengthwise direction for accommodating the needle strip. This step imparts precise seating to the needle strip so that its tips are located on a common circular arc outside the periphery of the circular comb. However, this is a prerequisite for a reliable combing operation. In assembling the circular comb, the needle strips are simply inserted between two pressure strips each. Their base contacts the step on the pressure strip. Further location is not necessary.

It has been found extremely advantageous to locate this step between the head of the lamination and the corresponding surface of the pressure member. The thickness of the lamination corresponds to the thickness of the needle strip so that there is virtually no play during the assembly and pressing together of the components of the circular comb. The outer end of the lamination is welded to the pressure surface of the pressure member.

It is within the scope of the invention that the fastening of the laminations for the pressure strips in the cutout of the basic element is such that at the bottom of the cutout there are parallel slots for accommodating the lower end of a lamination of a pressure member and the individual laminations are locked by means of studs running transversely to the lamination plane. These studs may be simple guide pins which engage a blind hole in the basic element. Also, threaded studs may be thread-fastened. As a rule, two such locking studs for each lamination are sufficient, because the forces to be absorbed by them are relatively small.

The flexible lamination is preferably made of spring steel so that, after detaching the clamping strip, the individual pressure members can be easily spread apart in order to get at the desired needle strip.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
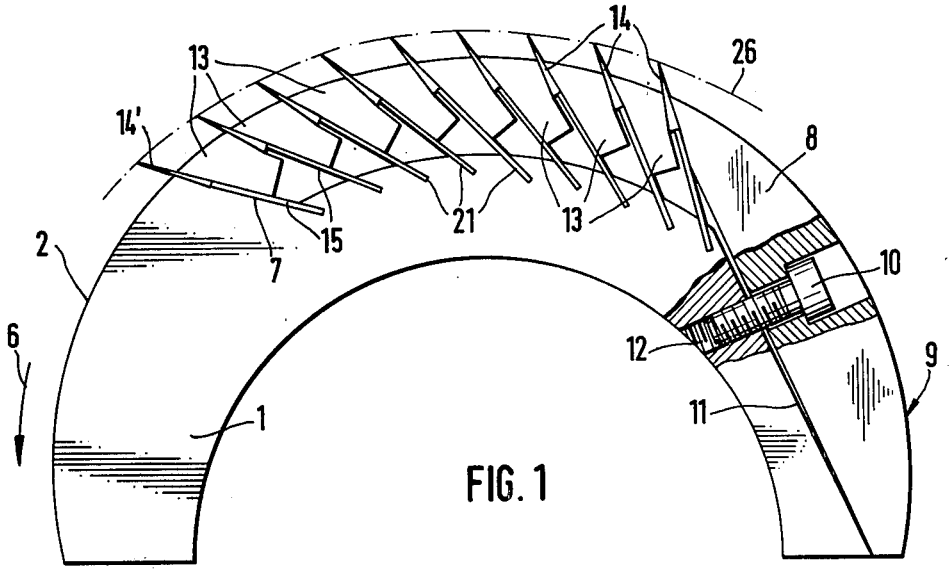
FIG. 1 shows a sideview of a first embodiment of a circular comb, with a partial section.
Figure 2:
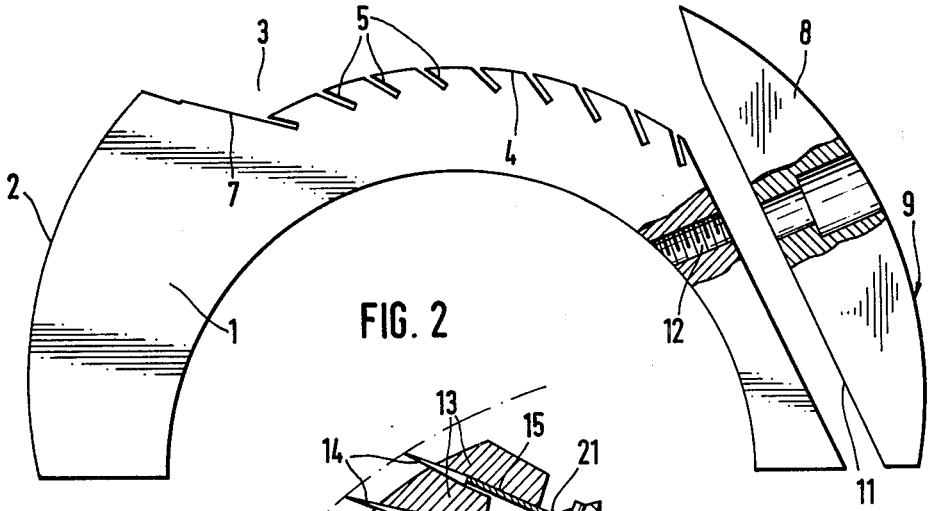
FIG. 2 shows the basic shape of the embodiment of FIG. 1 with the associated clamping strip.
Figure 3:
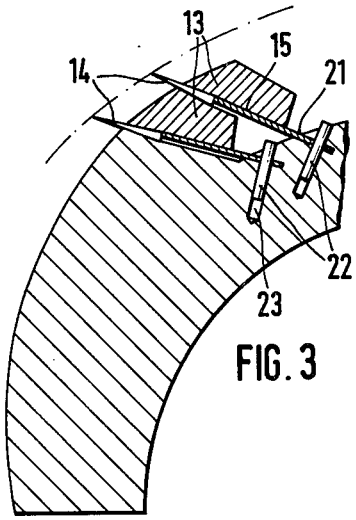
FIG. 3 shows a section in a radial plane through the circular comb of FIGS. 1 and 2, with parts broken away.

The circular comb for combing machines, shown in the drawing, comprises a segment like basic element 1 whose outside periphery 2 has a cutout 3. The bottom 4 of this cutout 3 is provided with a large number of equidistant narrow lengthwise slots, all of which make the same acute angle with the radius leading to their location. The cutout 3 with this embodiment is delimited on the forward end 6 (in the direction of rotation) by a surface 7, and at the opposite rear end by the projecting part 8 of a clamping strip 9 which forms a circle segment for the outer periphery 2 of the basic element 1; it is fastened by means of several setscrews 10, located in one row, on the seating area 11 of the basic element 1. The screws 10 engage a thread 12 in the basic element 1.

Figure 7:
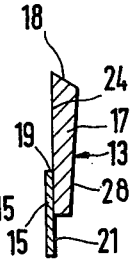
FIG. 7 shows a section taken along line VII-VII through the pressure strip of FIG. 6.

Into the resulting cutout 3 of the basic element, there is inserted a set of pressure strips each of which accommodates a needle strip 14. The identical pressure strips 13 comprise a lamination 15, preferably made of spring steel of rectangular cross-section (see FIG. 7), and the pressure member 17 fastened to the head of this lamination by means of spotwelds 16. The outside surface 18 of this pressure member corresponds to the peripheral surface 2 of the basic element 1. Between the head of lamination 15 and the pressure member 17 is a step 19 against which the base of the associated needle strip 14 rests.

The pressure strip 13 has holes 20. For fastening these pressure strips 13, the free end 21 of lamination 15 is inserted into a slot 5; through each bore 20, there extends a stud 22 which engages a bore 23 in the basic element 1. As long as the clamping strip 9 is not fastened to the basic element 1, the pressure strips 13 thus fastened can be easily spread out due to the spring force of its laminations 15 so that a needle strip 14 can be placed between every two pressure strips 13. The needle strips are reliably seated by the base bottoming on step 19 and the pressure surface 24 of the pressure member 17, so that the tips of all needles of all needle strips 14 are located on a common circular arc 26. The other surface 28 of the pressure member 17 serves as support for the subsequent needle strip 14.

If all needle strips 14 have been inserted into the pressure strips 13, which beforehand were placed into the cutout 3 of the basic element 1, the clamping strip 9 is fastened by means of its setscrews 10 to the basic element. From the free end 8 of this clamping strip 9, a tangential pressure is exerted on the next needle strip 14 which, in turn, is transmitted to the pressure strip 13 in front of it, continuing in this manner to the last pressure strip 13 which, with its pressure surface 24, presses the last needle strip 14' (see FIG. 1) and presses against the support surface 7 of the basic element 1.

In this manner, all pressure member 13 and all needle strips 14 are located permanently.

Figure 4:
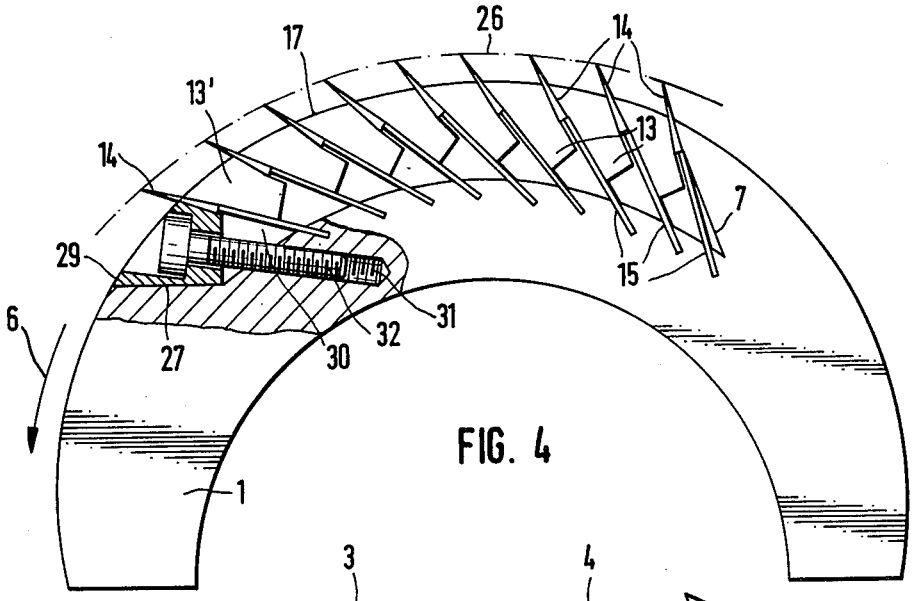
FIG. 4 shows another embodiment, corresponding to FIG. 1.
Figure 5:
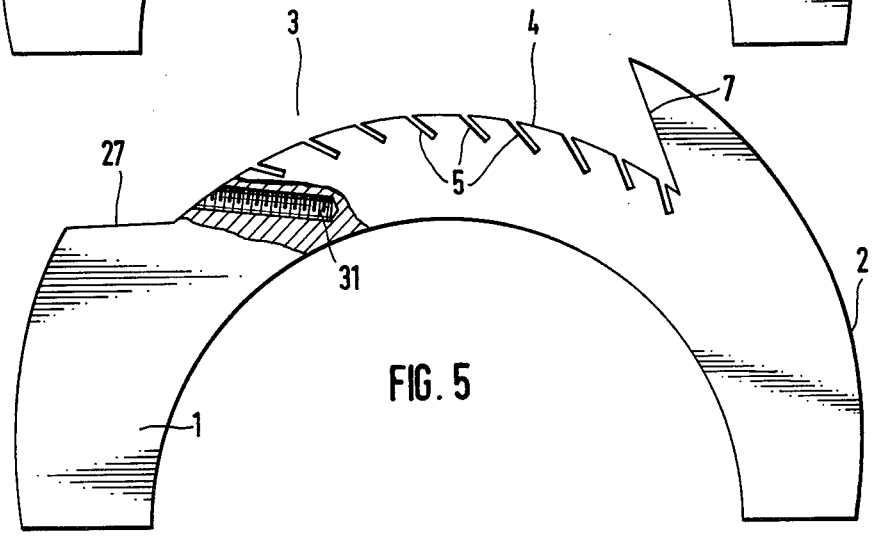
FIG. 5 shows a sideview of the associated basic element.
Figure 6:
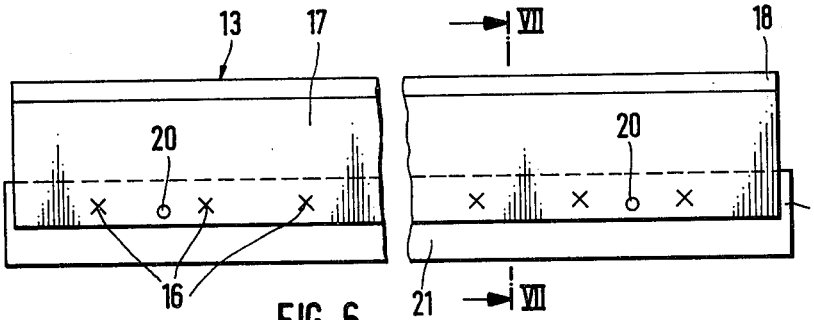
FIG. 6 shows a view of a pressure strip.

The embodiments of FIGS. 4 and 5 are a virtual reversal with respect to the arrangement of the pressure strips 13 in cutout 3 of the basic element 1 and the clamping strip. With basically the same arrangement, here the support surface 7 is located at the rear end of cutout 3 (in the direction of rotation of the basic element); the forward end is bounded by the contact surface 27 for the clamping strip 29 which in this embodiment has a wedgelike cross-section. If, in the circular comb assembly, the pressure member 13 and the needle strips 14 have been placed in the cutout 3, the clamping strip 29 is inserted in the remaining space 30 ahead of the last pressure member 13' and the needle strip 14 mounted on it, and tightened by means of the screws 32 threaded into the thread 31 of basic element 1. One wedge surface contacts the contact surface 27 of the basic element 1 and the other wedge surface contacts the last pressure member 13' or its needle strip 14. The pressure exerted thereby is transmitted by pressure member 13 to pressure member 13 and finally acts on the support surface 7 at the rear end of cutout 3, with all needle strips 14 being clamped.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. A circular comb for combing machines comprising a segment-shaped member having a cutout accommodating individual needle strips located parallel to each other and pressure strips inside said cutout of said segment-shaped member, said pressure strips comprising a pressure member and a flexible lamination connected to said pressure member, each of said pressure members being located between said needle strips and fastened to said segment-shaped member, fastening means for fastening a free end of said lamination to said segment-shaped member, a clamping strip at one end of said cutout and detachably connected to said segment-shaped member, said clamping strip pressing all needle strips and pressure members against one another and against an opposite lateral surface at the other end of said cutout, said lateral surface being a support surface for the adjacent needle strip.

2. The circular comb as defined in claim 1 wherein said clamping strip has the cross-section of a circular segment corresponding to said segment-shaped member.

3. The circular comb as defined in claim 1 wherein said clamping strip has a wedge-shaped cross-section.

4. The circular comb as defined in claim 1 wherein said pressure strip has a step at its pressure bearing surface, said step extending in longitudinal direction for holding said subsequent needle strip.

5. The circular comb as defined in claim 4 wherein said step is formed by the head portion of said lamination and the adjacent surface of said pressure member of the same pressure strip.

6. The circular comb as defined in claim 1 including parallel slots on said cutout for receiving the lower free end of each lamination of a pressure strip; said fastening means comprising bores and studs running transversely to the plane of said laminations for locking the individual laminations in said segment-shaped member.

7. The circular comb as defined in claim 1 wherein said lamination comprises spring steel, said lamination being welded to said pressure member.

* * * * *